United States Patent [19]

Ito et al.

[11] Patent Number: 4,551,003

[45] Date of Patent: Nov. 5, 1985

[54] ELECTROPHOTOGRAPHIC PROCESS AND APPARATUS THEREFOR

[75] Inventors: Michio Ito, Kawasaki; Nobuo Kitajima, Toride; Masanao Kasai, Tokyo; Shunichi Ishihara, Kodaira, all of Japan

[73] Assignee: Canon Kabushiki Kaisha, Tokyo, Japan

[21] Appl. No.: 520,580

[22] Filed: Aug. 5, 1983

Related U.S. Application Data

[60] Continuation of Ser. No. 270,587, Jun. 4, 1981, abandoned, which is a division of Ser. No. 31,592, Apr. 19, 1979, Pat. No. 4,286,032.

[30] Foreign Application Priority Data

Apr. 27, 1978 [JP] Japan ..... 53-50629
Jan. 31, 1979 [JP] Japan ..... 54-10178

[51] Int. Cl.[4] ..... G03G 15/00; G03G 15/02

[52] U.S. Cl. ..... 355/3 R; 355/3 CH; 355/14 CH; 355/14 E

[58] Field of Search ..... 355/3 R, 3 TR, 14 TR, 355/3 DD, 14 D, 3 CH, 14 CH, 14 E; 430/126, 55

[56] References Cited

U.S. PATENT DOCUMENTS

| | | | |
|---|---|---|---|
| 3,496,352 | 2/1970 | Jugle | 430/55 X |
| 3,615,395 | 10/1971 | Yamaji et al. | 430/126 X |
| 4,141,728 | 2/1979 | Hemphill | 430/126 |
| 4,197,119 | 4/1980 | Sadamatsu et al. | 355/3 CH X |
| 4,255,505 | 3/1981 | Hanada et al. | 355/3 CH X |

*Primary Examiner*—A. C. Prescott
*Attorney, Agent, or Firm*—Fitzpatrick, Cella, Harper & Scinto

[57] ABSTRACT

This invention presents a process and an apparatus for repeatedly forming a high contrast image on a photosensitive member substantially comprising a conductive layer a photoconductive layer and an insulating layer. According to this invention, during the processing steps of a latent image formed on the photosensitive member, an exposure step or means is provided for preventing the effect of a corona discharge of the same polarity as that of the photoconductive layer from affecting the succeeding latent image formation on the photosensitive member.

15 Claims, 16 Drawing Figures

ELECTROPHOTOGRAPHIC PROCESS AND APPARATUS THEREFOR

This is a continuation of application Ser. No. 270,587, filed June 4, 1981, now abandoned, which is a division of U.S. application Ser. No. 31,592, filed Apr. 19, 1979, now issued as U.S. Pat. No. 4,286,032.

BACKGROUND OF THE INVENTION

1. Field of the Invention

The present invention relates to an electrophotographic process and apparatus therefor, and more particularly to an electrophotographic process for achieving repeated image formation by means of a photosensitive member essentially composed of a conductive layer, a photoconductive layer and an insulating layer and an apparatus adapted for executing such process.

2. Description of the Prior Art

For the purpose of obtaining an image of a high contrast there is already known and commercially employed an electrophotographic process using a photosensitive member essentially consisting of a conductive layer, a photoconductive layer and an insulating layer and comprising, for example, a primary charging step for subjecting the surface of said photosensitive member to a uniform charging of a predetermined polarity, an image exposure step for exposing said surface to a light image, a secondary charging s applying, approximately simultaneously with said image exposure, a corona discharge containing a component of a polarity opposite to that of the primary charging, namely a DC corona discharge of said opposite polarity, an asymmetric AC corona discharge or an corona discharge, and a whole surface exposure step for uniformly illuminating the surface of said photosensitive member to form an electrostatic latent image, followed by the development and transfer of the thus formed latent image, thereby obtaining a reproduced image of said light image.

Also, even if such high-contrast image cannot be obtained, the electrophotographic processes utilizing a photo-sensitive member essentially composed of a conductive layer, a photoconductive layer and an insulating layer are known to be suitable for repeated use of the photosensitive member, as the surface thereof can be rendered physically and chemically durable.

Such photosensitive member has, however, been found to result in a significant loss in image contrast in the repeated image formation in case of a certain combination of the polarity of the developer, of the secondary charging and of the corona discharge for image transfer.

Such contrast loss has been a serious problem in certain processes, as such combination is, for example, indispensable for achieving a reversal development or for removing the excess liquid in a liquid development.

The above-mentioned drawback will be more specifically explained in an example of an electrophotographic process involving a reversal development shown in the attached drawings.

In such process schematically shown in FIG. 1, a photosensitive member A essentially composed of a conductive layer a1, a photoconductive layer a2 and an insulating layer a3 is at first subjected to a primary charging, for example, with a positive corona discharge in case said photoconductive layer a2 is of an N-type such as a CdS-binder system (FIG. 1(*a*)), then subjected to the exposure of a light image (L and D respectively indicating light and dark areas) simultaneously with a secondary charging with an AC corona or a DC corona containing a component of a polarity opposite to that of said primary charging (FIG. 1(*b*)), and is subjected to a whole surface exposure to obtain an electrostatic latent image wherein the light area L and the dark area D are respectively charged negatively and positively (FIG. 1(*c*)). The latent image thus obtained is rendered visible by reversal development with a dry or liquid developer T containing positively charged toner particles (FIG. 1(*d*)), and the thus developed image is transferred onto a transfer sheet or paper P by superimposing said transfer sheet P on the surface of the photosensitive member A and applying a negative corona discharge from the back side of said transfer sheet P (FIG. 1(*e*)). Successively, the photosensitive member utilized for the image formation is prepared for the succeeding imaging cycle by a cleaning step for eliminating the developer remaining on the surface of said photosensitive member.

In such process the contrast of the electrostatic latent image gradually decreases in the repeated use of the photosensitive member, and this phenomenon is attributed by the present inventors to the following facts.

In the image transfer step of the above-explained process the negative charging, through the transfer sheet, of the surface of the photosensitive member containing an N-type photoconductive layer induces a positive charge at the interface between the conductive layer a1 and the photoconductive layer a2, thus creating an electric field across the photoconductive layer.

The electrons which are injected from the conductive layer and retained at the interface between the photoconductive layer and the insulating layer in case of normal positive charging of the surface of the photosensitive member are repelled from the photoconductive layer to the conductive layer by the above-mentioned electric field, thus leaving positive spatial charges or positive holes in the photoconductive layer.

Said positive holes become retained in the traps in a gradually increasing number with the lapse of time.

Particularly in the case of a photoconductive layer containing an elevated number of barriers, such as a layer composed of ZnO or CdS and a binder, the above-mentioned positive holes are captured in deep traps and do not easily recombine.

Such trapped positive holes trap, in the vicinity thereof, the electrons injected at the succeeding primary charging, and likewise hinders the movement of the injected electrons toward the interface between the photoconductive layer and the insulating layer.

For this reason the electron injection to the interface between the photoconductive layer and the insulating layer becomes deficient, resulting in a lowered contrast in the succeeding imaging cycles.

Furthermore, such trapped positive holes, being dependent on the image exposure in the preceding image forming cycle, appear as a memorized image in the succeeding imaging cycle.

SUMMARY OF THE INVENTION

The object of the present invention is to provide an electrophotographic process capable of repeated image formation with a high contrast with a photosensitive member essentially consisting of a conductive layer, a photoconductive layer and an insulting layer, and an apparatus adapted for conducting such process.

Another object of the present invention is to provide an electrophotographic process capable of providing a reverse developed image of a satisfactory contrast and an apparatus adapted for conducting such process.

Still another object of the present invention is to provide an electrophotographic process to obtain a transferred image of a satisfactory contrast and an apparatus adapted for conducting such process.

More specifically, the present invention provides an electrophotographic process achieving image formation by repeated use of a photosensitive member essentially consisting of a conductive layer, a photoconductive layer and an insulating layer, said process being featured, in the image process steps to be applied to the photosensitive member after the latent image formation and at the corona discharge of a polarity the same as that of the material constituting the photoconductive layer of said photosensitive member, by providing an exposure step preventing the effect of said corona discharge on the succeeding latent image forming cycle on said photosensitive member.

A preferred embodiment of the present invention comprises, in an electrophotographic process repeatedly utilizing a photosensitive member essentially consisting of a conductive layer, a photoconductive layer and an insulating layer for image formation, a step of generating an electric field across said photoconductive layer for image processing and a step of eliminating the electric field generated in said electric field generating step.

Another preferred embodiment of the present invention comprises, in an electrophotographic process repeatedly utilizing a photosensitive member essentially consisting of a conductive layer, a photoconductive layer and an insulating layer, a step of forming an electrostatic latent image corresponding to light information having a light and dark contrast, a developing step for developing said electrostatic latent image formed on said photosensitive member, an exposure step for providing a light hysteresis of a predetermined period to the surface of said photosensitive member holding the thus developed image thereon, and a step of applying a corona discharge of a polarity the same as that of the photoconductive layer to said photosensitive member during the light hysteresis caused by said exposure step.

Also the present invention is to provide an apparatus adapted for conducting an electrophotographic process repeatedly utilizing a photosensitive member essentially consisting of a conductive layer, a photoconductive layer and an insulating layer, said apparatus being featured by a photosensitive member supported so as to allow cyclic displacemene primary corona discharge means for applying a corona discharge of a predetermined polarity to said photosensitive member, exposure means for applying to said photosensitive member light information corresponding to the image to be reproduced, secondary corona discharge means for applying, simultaneously with the exposure applied by said exposure means, a corona discharge containing a component of a polarity opposite to that of said primary corona discharge, whole surface exposure means for applying a uniform exposure to the surface of said photosensitive member, developing means for applying a developer charged in a polarity the same as that of said primary corona discharge to the electrostatic latent image formed on the surface of said photosensitive member, image processing corona discharge means for applying a corona discharge containing a component of a polarity the same as that of the photoconductive layer of said photosensitive member to the surface thereof after the latent image formation, and exposure means for applying an exposure to the surface of the photosensitive member thereby preventing the effect of the corona discharge of said image processing corona discharge means on the succeeding latent image formation on said surface.

DESCRIPTION OF THE PREFERRED EMBODIMENTS

Figure 1:
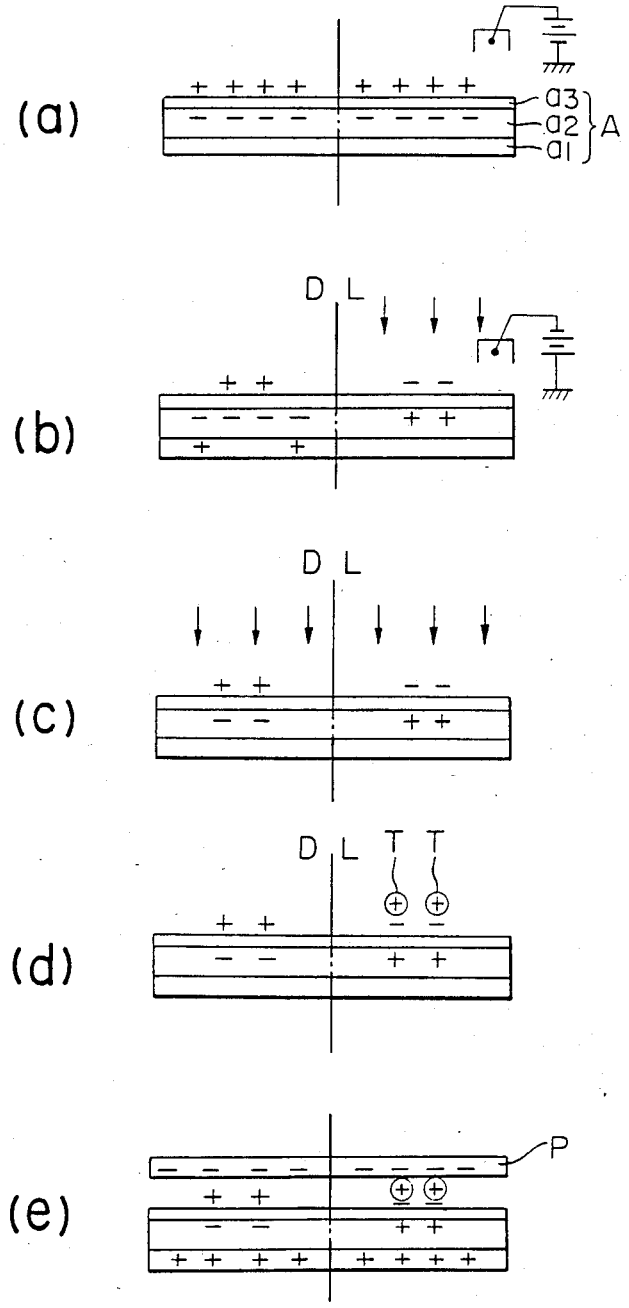
PRIOR ART FIG. 1
FIGS. 1(*a*)–1(*e*) are schematic views showing a conventional electrophotographic process, which improved by the present invention.
Figure 2:
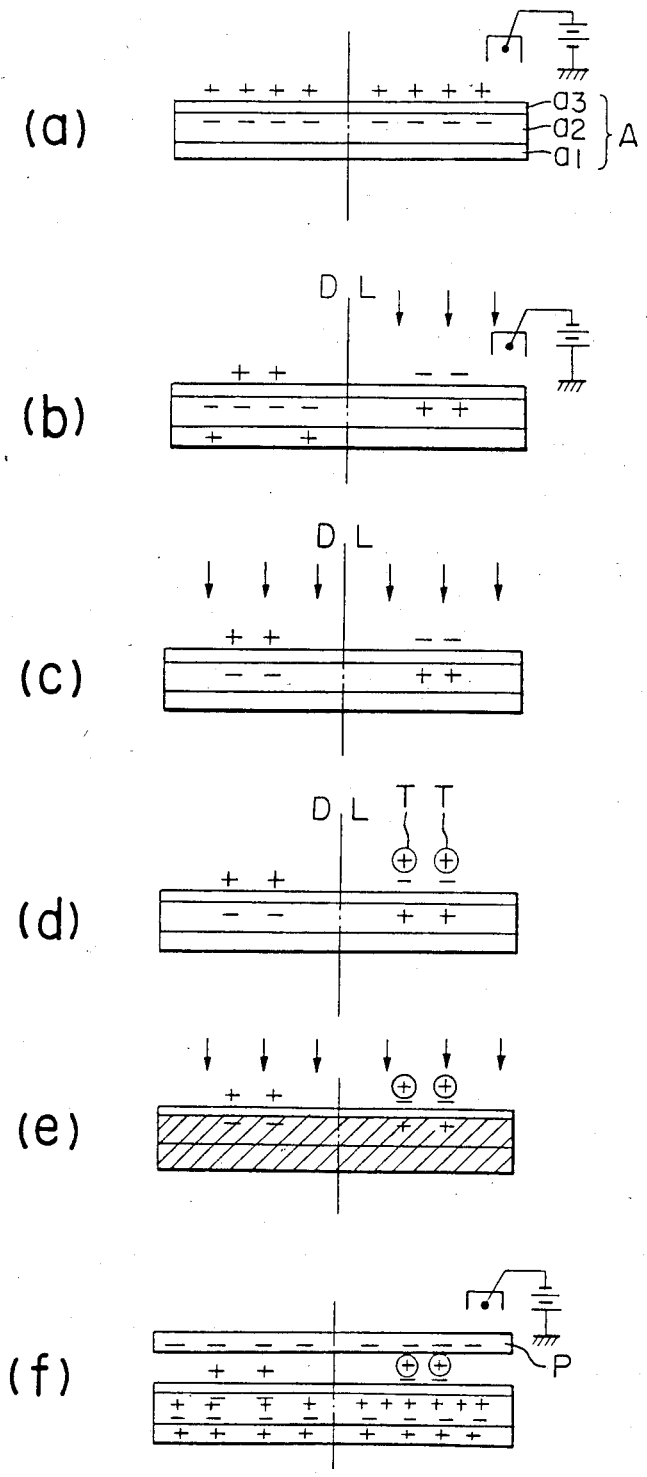
FIGS. 2(*a*)–2(*f*) are schematic views showing the electrophotographic process of the present invention.

The electrophotographic process according to the present invention is schematically shown in FIGS. 2(*a*)–2(*f*) wherein the components common with those shown in FIG. 1 are represented by the same symbols.

FIG. 2(*a*) shows a primary charging step for uniformly charging the surface of a photosensitive member A essentially composed of a conductive layer a1, a photoconductive layer a2 and an insulating layer a3 with a corona discharge of a predetermined polarity which is positive or negative, respectively, when said photoconductive layer is composed of an N-type material such as CdS or of a p-type material such as Se, the illustration being given for an N-type photoconductive layer.

FIG. 2(*b*) shows a step of exposing the surface of said photosensitive member thus uniformly charged to light information having a distribution of light and dark areas, for example, obtained by scanning an original, and simultaneously applying a corona discharge having a component of a polarity opposite to that of said primary charging, such as a DC corona discharge of such opposite polarity, an AC corona discharge or a combination thereof, the illustration being given for a negative DC discharge which is of an opposite polarity to that of the aforementioned primary charging.

FIG. 2(*c*) shows a whole surface exposure step for rapidly forming a surface potential distribution corresponding to the charge distribution formed by the above-mentioned light image exposure.

Thus an electrostatic latent image of a high contrast is formed on the surface of the photosensitive member.

FIG. 2(*d*) shows a developing step wherein said latent image is developed with a dry or liquid developer T containing toner particles charged in a polarity the same as that of the dark area D for rendering the light area L visible, thereby obtaining a so-called negative-positive reversal image. The foregoing steps are the same as those explained in connection with FIGS. 1(*a*-)-1(*d*).

FIG. 2(*e*) shows an exposure step for providing the photoconductive layer of the photosensitive member with a light hysteresis. By this exposure the photoconductive layer assumes a state of low resistance which is retained for a certain period as a light hysteresis.

FIG. 2(*f*) shows a transfer step conducted during the presence of the above-mentioned light hysteresis state, wherein a corona discharge of a polarity opposite to that of said toner particles (i.e. a negative corona discharge in the illustrated case) is applied to the back side of a transfer sheet, thereby transferring the developed image onto said transfer sheet. The negative corona discharge thus applied induces a positive charge in the conductive layer of the photosensitive member. The thus induced positive charge, which is not injected into the N-type photoconductive layer, but forms, in combination with the above-mentioned corona discharge, an electric field across the photoconductive layer if said N-type photoconductive layer is in a dark state, does not form such electric field when the photoconductive layer is in a low resistance state because of the light hysteresis as the negative carriers present in a good number in the photoconductive layer are attracted by said positive charge and migrate through said layer to neutralize said positive charge induced at the interface of the conductive layer and the photoconductive layer. In this manner the negative charge applied by the transferring corona discharge induces a positive charge on the conductive layer side.

However, because of the light hysteresis in the photoconductive layer caused by said exposure, the spatial charge which would otherwise be captured in deep traps are released in this state, and electron-positive hole pairs are generated under the low resistance state of the photoconductive layer, so that a charge of the opposite polarity induced in the vicinity of the interface between the conductive layer and the photoconductive layer is immediately eliminated.

For this reason it is rendered possible to eliminate the dang of formation of an electric field across the photoconductive layer.

The absence of such electric field eliminates the undesirable effect of the corona discharge on the succeeding image formation. The photosensitive member, after completion of image transfer in such state, is subjected to a cleaning step and is thus prepared for the succeeding image formation.

Also according to the present invention the order of the above-mentioned steps shown in FIGS. 2(*e*) and 2(*f*) may be inverted. The exposure step in this case is conducted after the step of applying a corona discharge of a polarity the same as that of the photoconductive layer in the same manner as in the foregoing transfer step. In such inverted procedure an electric field is formed across the photoconductive layer by the negative charge applied by the transferring corona discharge, but such electric field is immediately cancelled by the succeeding exposure.

More specifically the negative charge applied on the surface of the insulating layer of the photosensitive member by the transfer corona discharge induces a positive charge on the conductive layer to form an electric field as explained in the foregoing. However, the succeeding exposure releases the spatial charges from the deep traps in the photoconductive layer, and electron-positive hole pairs are formed in the low resistance state of said photoconductive layer, whereby the positive charge induced in the vicinity of the interface between the conductive layer and the photoconductive layer is cancelled to annul the above-mentioned electric field.

Naturally the step of FIG. 2(*e*) can be conducted simultaneously with the step of FIG. 2(*f*), but the exposure cannot be conducted efficiently because of the presence of the transfer sheet and would require an extremely large amount of light in order to achieve a satisfactorily low resistance in the photoconductive layer.

This will be understood from the fact that the light transmission of ordinary business paper or letter paper is in a range of 15–30%. For example, the light transmission is 24% in the case of linen bond paper of 81 $g/m^2$, 23% in the case of bank bond paper of 100 $g/m^2$, and 28% in the case of high quality white bond paper of 64 $g/m^2$.

It is to be noted that the corona discharge leading to the contrast loss is not necessarily limited to the transfer corona discharge of a polarity the same as that of the photoconductive layer.

For example, in the case of forming a latent image with a simultaneous process, as shown, for example, in U.S. Pat. No. 3,666,363, on a photosensitive member containing an N-type photoconductive layer, said latent image is composed of positively charged dark area D and non-charged or negatively charged light area L. After development with a liquid developer containing negatively charged toner particles, there is required a negative squeezing corona discharge, which, however, results in the formation of an electric field across the photoconductive layer. Therefore, also in the case of such squeezing corona discharge, the above-mentioned post exposure can be advantageously employed prior to, simultaneously with or succeeding said corona discharge.

Figure 3:
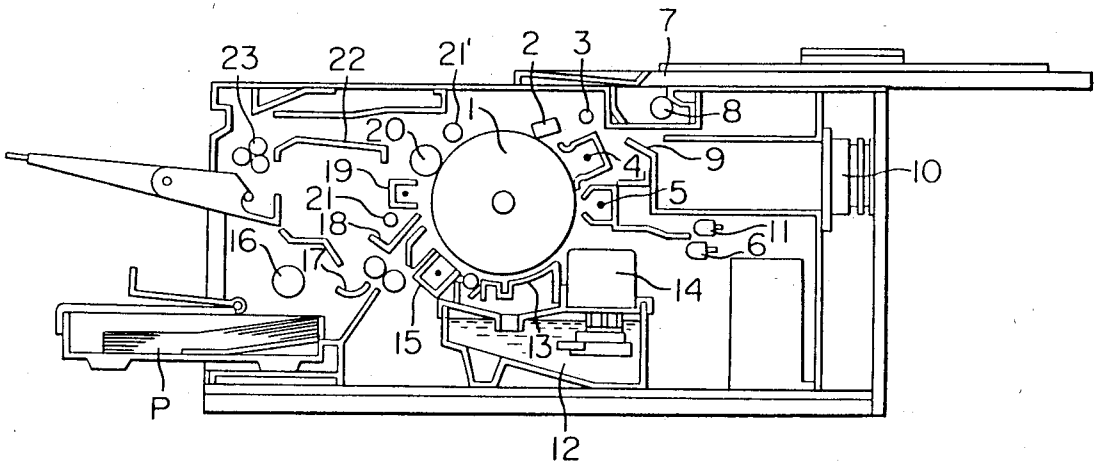
FIG. 3 is a schematic view of the electrophotographic apparatus embodying the present invention.

Now, reference is made to FIG. 3 showing, in a lateral view, an electrophotographic apparatus embodying the present invention.

A photosensitive drum 1 is composed of an aluminum foil serving as the conductive layer, which is coated, in a thickness of 50 microns, with a photoconductive layer composed of powdered CdS and a binder, and further covered with a Myler sheet of 35 micron thickness as the insulating layer, said drum being rotated clockwise.

Approximately on the top of said photosensitive drum 1 there are provided an elastic cleaning blade 2 consisting of rubber or synthetic resin and a pre-exposure lamp 3 for conditioning the surface of the photosensitive drum for image formation. Along the descending periphery photosensitive drum 1 there is provided a latent image comprising a primary corona discharger 4 for applying a positive charge onto the surface of said photosensitive drum, a secondary corona discharger 5 for applying a DC corona discharge of a polarity opposite to that of said primary corona discharge or an AC corona discharge, and a whole surface exposure lamp 6.

For the purpose of exposing the photosensitive drum to the light image there is provided an original support table 7, an original illuminating light source 8, a reflecting mirror 9 and an in-mirror lens 10, wherein said exposure is conducted through an optically open back of said secondary corona discharger. Naturally, said light image exposure may also be conducted, for example, from a cathode ray tube or by means of a laser beam.

Under the photosensitive drum 1 there is provided a developing station 12 for developing the electrostatic latent image formed on said photosensitive drum. In the illustrated embodiment, the development is achieved with a liquid developer containing positively charged toner particles dispersed in a carrier liquid for performing a positive-negative reversal development; and 13 is a developing tray for bringing the liquid developer into contact with the surface of the photosensitive drum, and 14 is a supply pump for feeding the liquid developer to said developing tray. Succeeding said developing station 12 there is provided a squeezing post-corona discharger 15 for removing the excessive liquid developer. Said squeezing effect can be obtained by a corona discharge of either polarity, but preferably by a positive corona discharge, namely, of the same polarity as that of the toner particles, since in this case it is possible to prevent the streaking of the developed image in addition to the above-mentioned squeezing effect.

Also, there is provided a paper feed roller 16, a paper guide 17 and a timing roller 18 in order to guide a transfer sheet P to the transfer position.

Above the squeezing corona discharger there is provided a transfer corona discharger 19 for applying a negative corona discharge on the back side of said transfer sheet to attract the developed image thereonto.

Between said transfer corona discharger 19 and said post-corona discharger 15 there is provided a post-exposure source 21 composed, for example, of a tungsten lamp.

Upon exposure to said light source 21, the photosensitive drum holding the developed image thereon assumes a low resistance state, i.e., the light hysteresis, during the existence of which the photosensitive drum does not generate an electric field across the photoconductive layer even upon receipt of the above-mentioned transfer corona discharge. Said light source 21 may also be positioned above said transfer corona discharger 19 as indicated by 21'.

Along the upper periphery of the photosensitive drum there is provided a separating means such as a separating roller 20 for separating the transfer sheet from the photosensitive drum.

Adjacent to said separating means there is positioned a hot-plate fixing station 22 for fixing the transferred image on said transfer sheet and a feed roller 23 for ejecting the transfer sheet from the apparatus after the fixing step.

In an image forming apparatus with a negative-positive reversal development as explained in the foregoing, the negative charge applied on the photosensitive drum by said transfer corona discharge may lead to the formation of an undesirable electric field across the photoconductive layer, but the above-explained post exposure light source 21 eliminates the possibility of such electric field formation, thus avoiding the cause of the fatigue of the photosensitive drum.

Such arrangement therefore prevents the loss of contrast even in continuous image formation and enables satisfactory image reproduction.

Furthermore, in case such adverse electric field across the photoconductive layer results from any other cause than the above-mentioned transfer corona discharge, it is likewise effective to apply a post-exposure prior to, simultaneously with or succeeding the step resulting in the formation of such electric field.

The present invention will be further clarified from the following example.

EXAMPLE

An aluminum drum with a polished surface was coated, in a thickness of 50 microns, with a photosensitive material composed of a mixture of 10 parts by weight of polyvinyl chloride with 100 parts by weight of cadmium sulfide activated with small amounts of copper and indium to form a photoconductive layer, which was further covered with a Mylar (trade name) sheet of about 35 microns thickness.

The photosensitive drum thus obtained was utilized for image formation in an apparatus shown in FIG. 3.

In the imaging process the primary corona discharger 1 was supplied with a DC current of +6.5 kV while the secondary corona discharger was supplied with an AC current of 7.2 kV. Also, the squeezing post-corona discharger was supplied with a DC current of +7.5 kV while the transfer corona discharger was supplied with a DC current of −5.0 kV. The photosensitive drum was utilized for repetitive image formation at a peripheral speed of 59 mm/sec, and the post-exposure for creating the light hysteresis was applied for 0.2 sec. at an intensity of 66 $W/cm^2$ and 0.3 sec. prior to the application of the transfer corona discharge. Stated differently, the photosensitive member exposed to said transfer corona discharge was in a light hysteresis state of 0.3 sec. In such process the change in the dark potential was less than 0.2 even after 500 cycles of repeated image formation, and the image memory effect resulting from the adverse electric field caused by said transfer corona discharge could not be observed.

Figure 4:
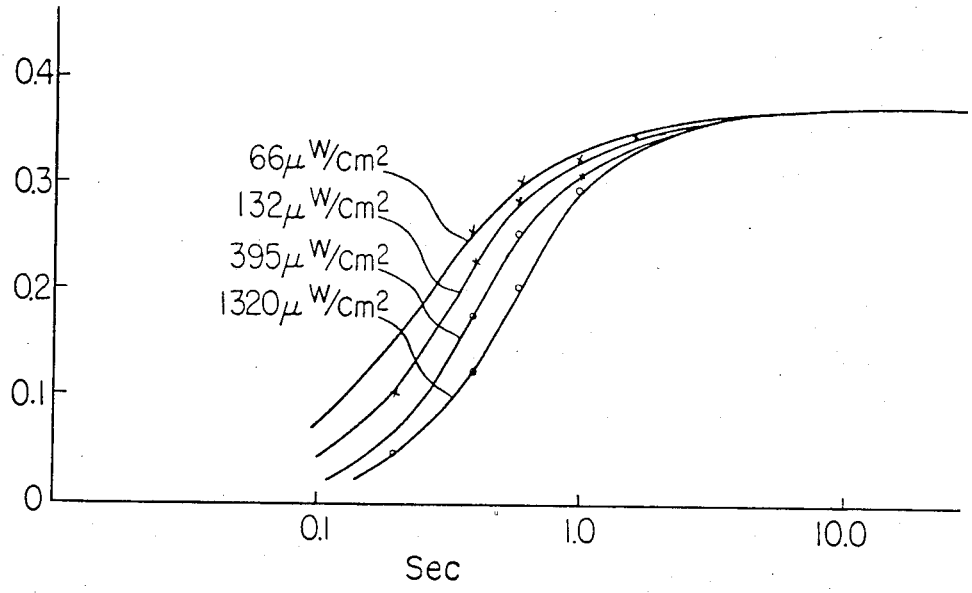
FIG. 4 is a chart showing the relationship between the period of light hysteresis and the dark potential in the repeated image formation in the apparatus embody present invention.

FIG. 4 shows the change in the dark potential in various light hysteresis states created by a post-exposure of 66, 132, 395 and 1320 $W/cm^2$ for 0.2 seconds, wherein the abscissa represents the period of light hysteresis in seconds while the ordinate represents the dark potential change rate after 500 imaging cycles, i.e. the difference between the dark potential in the first cycle Vd 1 and the dark potential in the 500the cycle Vd 500 divided by Vd 1.

Figure 5:
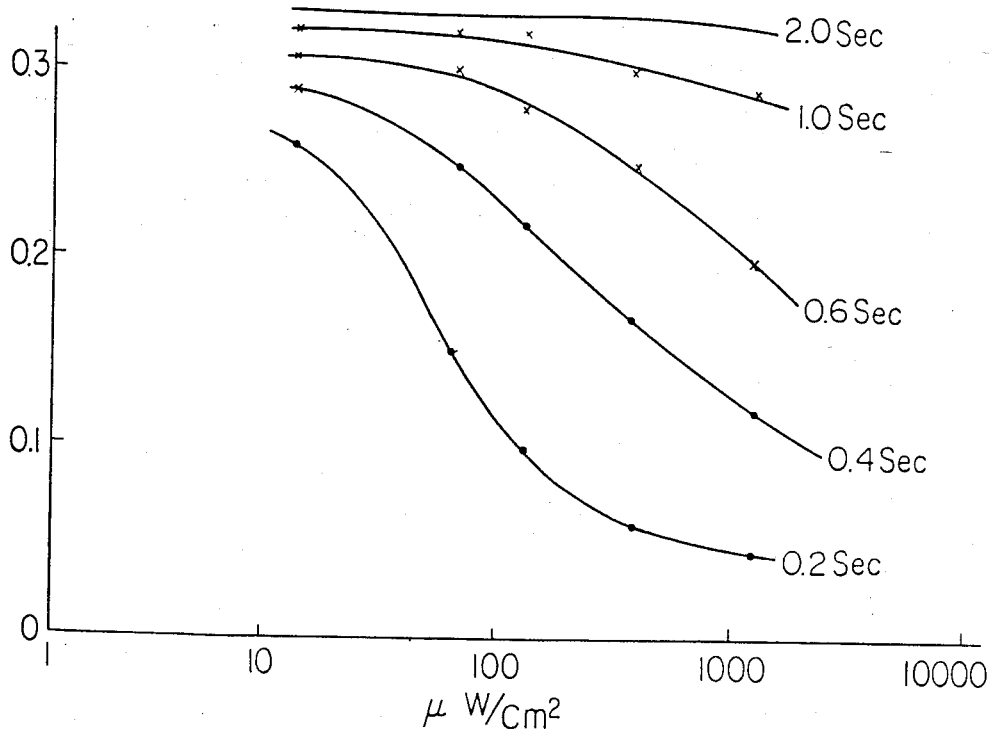
FIG. 5 is a chart showing the relationship between the intensity of exposure providing the light the dark potential decay.

Also FIG. 5 shows the relation between the dark potential change rate as defined above in the ordinate and the post-exposure intensity ($W/cm^2$) in the abscissa at the light hysteresis time of 0.2, 0.4, 0.6, 1.0 or 1.2 sec. In all cases the post-exposure was conducted for 0.2 seconds. It will be seen from this chart that a satisfactory high contrast can be obtained even after repeated image formation if a predetermined light hysteresis is obtained with a sufficiently high light intensity.

According to the investigation of the present inventors it is confirmed that a satisfactory result cannot be obtained with the above-mentioned post-exposure if the electric field across the photoconductive layer has existed for a prolonged period. This is presumably due to the fact that the spatial charges present in the photoconductive layer are completely captured in the deep traps with the lapse of time.

Figure 6:
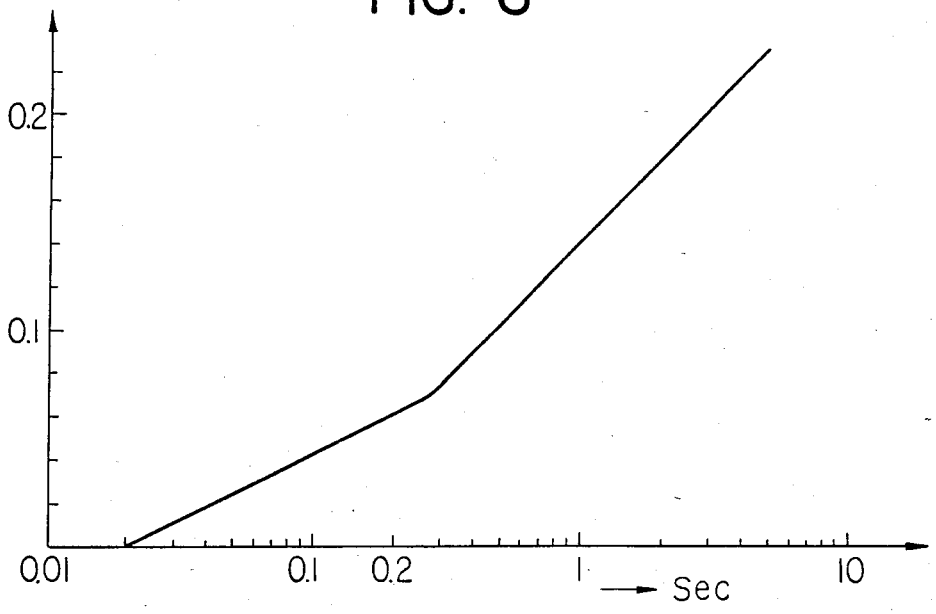
FIG. 6 is a chart showing the dark potential decay as a function of the period of post-exposure for eliminating the electric field.

Thus FIG. 6 shows the change in the dark potential after 1000 cycles of electric field formation across the photoconductive layer followed by cancellation of said electric field with a post-exposure after different times, wherein the abscissa represents time in seconds while the ordinate represents the difference between the dark potential in the first cycle Vd 1 and that in th 1000th cycle Vd 1000 divided by Vd 1. The change in the time to the post-exposure was achieved by changing the position of said post-exposure in the apparatus shown in FIG. 3.

As can be seen from this chart, the loss of contrast becomes apparent if the time is equal to or longer than ca. 0.3 seconds.

Figure 7:
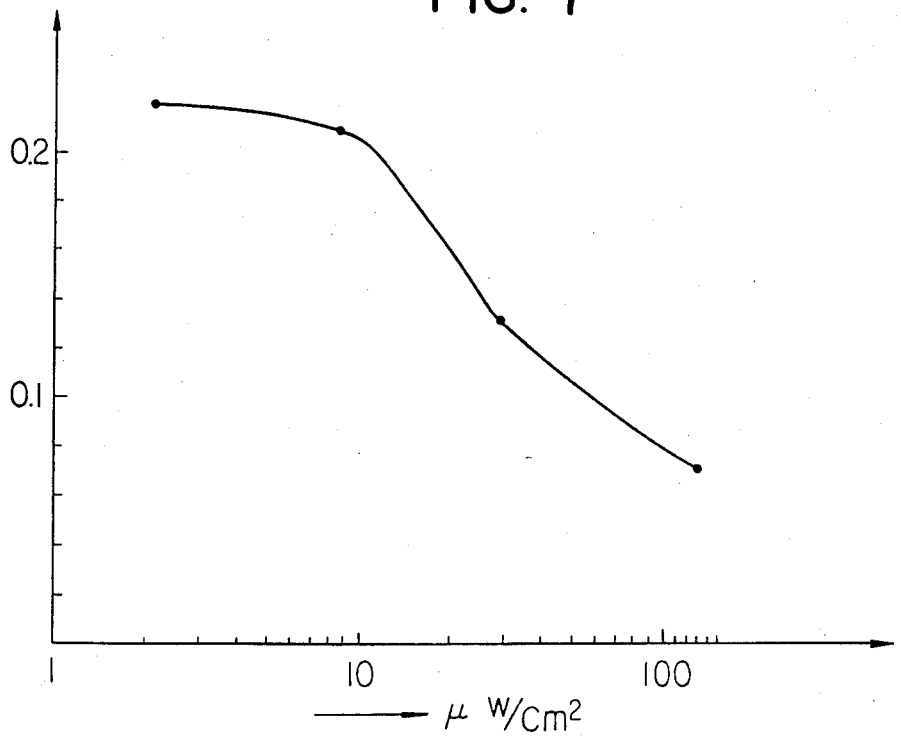
FIG. 7 is a chart showing the dark potential decay as a function of the amount of post-exposure for eliminating the electric field.

FIG. 7 shows the change in the dark potential after 20 cycles of electric field formation followed by post-exposure with a light of 800 nm of different intensities after 0.3 seconds, wherein the abscissa representing the amount of post-exposure in $W/cm^2$ while the ordinate representing the difference between the dark potential in the first cycle Vd 1 and that in the 10the cycle Vd 20 divided by Vd 1.

It will be observed that a satisfactory contrast could be maintained with an intensity of 8 $W/cm^2$ or higher. It will therefore be understood that the number of incident photons becomes equal to or exceeds the number of trapped spatial charged respectively at said light intensity or at highly light intensity.

What is claimed is:

1. An electrophotographic apparatus including a movable photosensitive member for use in making repeated image formations, wherein the photosensitive member essentially comprises a conductive layer, an insulating surface layer, and a photoconductive layer of a particular polarity type material interposed between said conductive layer and said insulating surface layer, said apparatus comprising:

means for forming an electrostatic latent image on the photosensitive member;

means for applying a developer to the latent image bearing photosensitive member;

corona discharging means, disposed downstream of said developer applying means with respect to movement of said photosensitive member, for applying a corona discharge to said photosensitive member bearing said developed image, said discharge having a polarity which is the same as the polarity type of the photoconductive layer, to form an electric field across the photoconductive layer of said photosensitive member; and means, disposed downstream of said corona discharging means with respect to movement of said photosensitive member, for exposing the photosensitive member to light to eliminate said electric field across the photoconductive layer whereby the lowering of the image contrast is substantially prevented.

2. An apparatus according to claim 1, wherein said developer includes toner particles electrically charged to the same polarity as the polarity type of the photoconductive layer; and said corona discharging means is a post-charger acting, before image transfer, on the photosensitive member which bears the developer.

3. An apparatus according to claim 2 wherein said latent image forming means comprises, primary charging means for uniformly applying charges of a predetermined polarity on the photosensitive member, the predetermined polarity being opposite to the polarity type of the photoconductive layer, means for exposing said photosensitive member to light information after application of the primary charge, said light information corresponding to an image to be reproduced on the photosensitive member, secondary corona discharging means for applying a corona discharge to said photosensitive member substantially simultaneously with the light information exposure, said secondary corona discharge having a component of a polarity opposite to the primary corona discharge, and means for uniformly exposing the whole surface of the photosensitive member to light, after the light information exposure.

4. An apparatus according to claim 1, wherein the developer includes toner particles electrically charged to a polarity opposite to the polarity type of the photoconductive layer, and wherein said corona discharger is a transfer charger, said apparatus further comprising means for feeding a transfer material between said corona discharger and said photosensitive member.

5. An apparatus according to claim 4, wherein said latent image forming means comprises, primary charging means for uniformly applying charges of a predetermined polarity on the photosensitive member, the predetermined polarity being opposite to the polarity type of the photoconductive layer, means for exposing said photosensitive member to light information after application of the primary charge, said light information corresponding to an image to be reproduced on the photosensitive member, secondary corona discharging means for applying a corona discharge to said photosensitive member substantially simultaneously with the light information exposure, said secondary corona discharge having a component of a polarity opposite to the primary corona discharge, and means for uniformly exposing the whole surface of the photosensitive member to light, after the light information exposure.

6. An electrophotographic apparatus including a movable photosensitive member for use in making repeated image formations wherein the photosensitive member essentially comprises a conductive layer, an insulating surface layer, and a photoconductive layer of a particular polarity type material interposed between said conductive layer and said insulating surface layer, said apparatus comprising;

means for forming an electrostatic latent image on the photosensitive member;

means for applying a developer to the latent image bearing photosensitive member;

means, disposed downstream of said developer applying means with respect to movement of said photosensitive member, for exposing the photosensitive member to light to provide said photoconductive layer with light hysteresis;

corona discharging means, disposed downstream of said exposure means with respect to movement of said photosensitive member, for applying a corona discharge to the photosensitive member which bears the developer, while said light hysteresis remains, wherein the corona discharge has a polarity which is the same as the polarity type of the photosensitive layer, and wherein said application of light substantially prevents a lowering of image contrast.

7. An apparatus according to claim 6, wherein said developer includes toner particles electrically charged to the polarity which is the same as the polarity type of the photoconductive layer; and said corona discharging means is a post charger acting, before image transfer, on the photosensitive member which bears the developer.

8. An apparatus according to claim 7, wherein said latent image forming means comprises, primary charging means for uniformly applying charges to a predetermined polarity on the photosensitive member, the predetermined polarity being opposite to the polarity type of the photoconductive layer, means for exposing said photosensitive member to light information after application of the primary charge, said light information corresponding to an image to be reproduced on the photosensitive member, secondary corona discharging means for applying a corona discharge to said photosensitive member substantially simultaneously with the light information exposure, said secondary corona discharge having a component of a polarity opposite to the primary corona discharge, and means for uniformly exposing the whole surface of the photosensitive member to light, after the light information exposure.

9. An apparatus according to claim 6, wherein the developer includes toner particles electrically charged to a polarity opposite to the polarity type of photoconductive layer, and wherein said corona discharger is a transfer charger, said apparatus further comprising means for feeding a transfer material between said corona discharger and said photosensitive member.

10. An apparatus according to claim 9, wherein said latent image forming means comprises, primary charging means for uniformly applying charges of a predetermined polarity on the photosensitive member, the predetermined polarity being opposite to the polarity type of the photoconductive layer, means for exposing, after application of the primary charge, said photosensitive member to light information corresponding to an image to be reproduced on the photosensitive member, secondary corona discharging means for applying a corona discharge to said photosensitive member substantially simultaneously with the light information exposure, said secondary corona discharge having a component of a polarity opposite to the primary corona discharge, and means for uniformly exposing the whole surface of the photosensitive member to light, after the light information exposure.

11. An electrophotographic apparatus including a movable photosensitive member for use in making repeated image formations, wherein the photosensitive member essentially comprises a conductive layer, an insulating surface layer, and a photoconductive layer of a particular polarity type material interposed between said conductive layer and said insulating surface layer, said apparatus comprising:

means for forming an electrostatic latent image on the photosensitive member;

means for applying a developer to the latent image bearing photosensitive member;

corona discharging means, disposed downstream of said developer applying means with respect to movement of said photosensitive member, for applying a corona discharge to said photosensitive member bearing said developed image, said discharge having a polarity which is the same as the polarity type of the photoconductive layer; and means disposed downstream of said developer applying means with respect to movement of said photosensitive member, for exposing the photosensitive member to light to prevent said corona discharging means from forming an electric field across the photoconductive layer whereby the lowering of the image contrast is substantially prevented.

12. An apparatus according to claim 11, wherein said developer includes toner particles electrically charged to the same polarity as the polarity type of the photoconductive layer; and said corona discharging means is a post-charger acting, before image transfer, on the photosensitive member which bears the developer.

13. An apparatus according to claim 12 wherein said latent image forming means comprises, primary charging means for uniformly applying charges of a predetermined polarity on the photosensitive member, the predetermined polarity being opposite to the polarity type of the photoconductive layer, means for exposing said photosensitive member to light information after application of the primary charge, said light information corresponding to an image to be reproduced on the photosensitive member, secondary corona discharging means for applying a corona discharge to said photosensitive member substantially simultaneously with the light information exposure, said secondary corona discharge having a component of a polarity opposite to the primary corona discharge, and means for uniformly exposing the whole surface of the photosensitive member to light, after the light information exposure.

14. An apparatus according to claim 11, wherein the developer includes toner particles electrically charged to a polarity opposite to the polarity type of the photoconductive layer, and wherein said corona discharger is a transfer charger, said apparatus further comprising means for feeding a transfer material between said corona discharger and said photosensitive member.

15. An apparatus according to claim 14, wherein said latent image forming means comprises, primary charging means for uniformly applying charges of a predetermined polarity on the photosensitive member, the predetermined polarity being opposite to the polarity type of the photoconductive layer, means for exposing said photosensitive member to light information after application of the primary charge, said light information corresponding to an image to be reproduced on the photosensitive member, secondary corona discharging means for applying a corona discharge to said photosensitive member substantially simultaneously with the light information exposure, said secondary corona discharge having a component of polarity opposite to the primary corona discharge, and means for uniformly exposing the whole surface of the photosensitive member to light, after the light information exposure.

* * * * *

UNITED STATES PATENT AND TRADEMARK OFFICE

CERTIFICATE OF CORRECTION

PATENT NO. : 4,551,003

DATED : November 5, 1985

INVENTOR(S) : MICHIO ITO, ET AL.

It is certified that error appears in the above-identified patent and that said Letters Patent is hereby corrected as shown below:

AT [57] IN THE ABSTRACT

Line 4, before "a" insert --,--.

COLUMN 1

Line 29, "charging s" should read --charging step for--.
Line 34, after "an" insert --the--.

COLUMN 2

Line 48, "hinders" should read --hinder--.

COLUMN 3

Line 50, "displacemene" should read --displacement,--.

COLUMN 4

Line 10, after "which" insert --should be--.
Line 18, "embody" should read --embodying the--.
Line 21, after "the light" insert --hysteresis and--.

COLUMN 5

Line 24, "as" should read --since--.
Line 34, "charge" should read --charges--.
Line 42, "dang of" should read --danger of--.

UNITED STATES PATENT AND TRADEMARK OFFICE

CERTIFICATE OF CORRECTION

PATENT NO. : 4,551,003

DATED : November 5, 1985

INVENTOR(S) : MICHIO ITO, ET AL.

It is certified that error appears in the above-identified patent and that said Letters Patent is hereby corrected as shown below:

COLUMN 6

Line 46, "Myler sheet" to read --Mylar sheet--.
Line 53, after "periphery" insert --of said--.
Line 54, after "image" insert --forming means--.

COLUMN 7

Line 54, "post exposure" should read --post-exposure--.

COLUMN 8

Line 14, delete "1".
Line 16, "of" should read --at--.
Line 17, "of" should read --at--.
Line 23, "66 W/cm$^2$" should read --66 $\mu$W/cm$^2$--.
Line ~~24~~ 34, "1320 W/cm$^2$" should read --1320 $\mu$W/cm$^2$--.
Line 39, "500the" should read --500th--.
Line 43, "(W/cm$^2$)" should read --($\mu$W/cm$^2$)--
Line 64, "th 1000th" should read --the 1000th--.

COLUMN 9

Line 8, "W/cm$^2$" should read --$\mu$W/cm$^2$--.
Line 10, "10the cycle" should read --20th cycle--.
Line 13, "8 W/cm$^2$" should read --8 $\mu$W/cm$^2$--.
Line 16, "charged" should read --charges--.
Line 17, "highly" should read --higher--.

UNITED STATES PATENT AND TRADEMARK OFFICE

CERTIFICATE OF CORRECTION

PATENT NO. : 4,551,003

DATED : November 5, 1985

INVENTOR(S) : MICHIO ITO, ET AL.

It is certified that error appears in the above-identified patent and that said Letters Patent is hereby corrected as shown below:

COLUMN 10

Line 65, "post charges" should read --post-charges--.

COLUMN 11

Line 2, "to" should read --of--.
Line 23, after "of" insert --the--.

Signed and Sealed this

*Twelfth* Day of *August 1986*

[SEAL]

*Attest:*

*Attesting Officer*

DONALD J. QUIGG

*Commissioner of Patents and Trademarks*